US008622383B2

(12) United States Patent
Lee

(10) Patent No.: US 8,622,383 B2
(45) Date of Patent: Jan. 7, 2014

(54) PAPER CASSETTE AND IMAGE FORMING APPARATUS HAVING THE SAME

(75) Inventor: Ho-il Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/551,850

(22) Filed: Jul. 18, 2012

(65) Prior Publication Data

US 2013/0161898 A1 Jun. 27, 2013

(30) Foreign Application Priority Data

Dec. 23, 2011 (KR) ..... 10-2011-0141754

(51) Int. Cl.
*B65H 1/00* (2006.01)

(52) U.S. Cl.
USPC ..... 271/171

(58) Field of Classification Search
USPC ..... 271/171, 145; 399/393
See application file for complete search history.

(56) References Cited

U.S. PATENT DOCUMENTS

| | | | | |
|---|---|---|---|---|
| 5,292,117 | A * | 3/1994 | Takagi et al. | 271/234 |
| 5,333,852 | A * | 8/1994 | Milillo et al. | 271/171 |
| 5,586,757 | A * | 12/1996 | Nakamatsu et al. | 271/145 |
| 7,543,812 | B2 * | 6/2009 | Underwood et al. | 271/145 |
| 7,694,958 | B2 * | 4/2010 | Nakamura | 271/171 |
| 8,469,357 | B2 * | 6/2013 | Furusawa | 271/171 |
| 2011/0298174 | A1 * | 12/2011 | Wang | 271/226 |
| 2012/0205859 | A1 * | 8/2012 | Nishioka | 271/145 |

FOREIGN PATENT DOCUMENTS

JP 06032468 A * 2/1994 ..... B65H 1/26

* cited by examiner

*Primary Examiner* — Jeremy R Severson
(74) *Attorney, Agent, or Firm* — Stanzione & Kim, LLP

(57) ABSTRACT

A paper cassette of an image forming apparatus including: a cassette body containing sheets of paper, and a paper alignment apparatus mounted in the cassette body. The paper alignment apparatus including: an alignment apparatus body having a paper alignment surface contactable with corners of one side of sheets of paper and slidable in a horizontal direction, and a locking unit mounted in the alignment apparatus body and locked into the cassette body. The locking unit is downwardly pressed when being locked and unlocked.

18 Claims, 10 Drawing Sheets

PAPER CASSETTE AND IMAGE FORMING APPARATUS HAVING THE SAME

CROSS-REFERENCE TO RELATED APPLICATIONS

This application claims priority from Korean Patent Application No. 10-2011-0141754, filed on Dec. 23, 2011 in the Korean Intellectual Property Office, the disclosure of which is incorporated herein by reference in its entirety.

BACKGROUND OF THE INVENTION

1. Field of the Invention

Methods and apparatuses consistent with exemplary embodiments relate to a paper cassette and an image forming apparatus having the same, and more particularly, to a paper cassette which includes a paper alignment apparatus, and an image forming apparatus having the same.

2. Description of the Related Art

In general, an image forming apparatus refers to an apparatus that transfers an image signal to paper, which is a recording medium, in the form of a visual image according to a digital signal input from a computer or a scanner, and includes a facsimile machine, a laser printer, an light emitting diode (LED) printer, a digital photocopier, and a multifunction peripheral.

Such an image forming apparatus includes an image forming unit, that records a predetermined image on paper, and a paper cassette that supplies paper to the image forming unit. The paper cassette generally includes a paper alignment apparatus to align sheets of paper contained in the paper cassette.

The paper alignment apparatus generally includes an alignment apparatus body that is slidable in a paper advancing direction (a lengthwise direction of the paper cassette) and regulates a location of an inner end of paper, thereby aligning sheets of paper, and a locking unit that locks the paper alignment apparatus into a cassette body.

If the locking unit is locked into the cassette body, the paper alignment apparatus is fixed to the cassette body, and, if the locking unit is unlocked from the cassette body, the paper alignment apparatus is placed in a slidable state.

For example, the locking and the unlocking of the locking unit may be performed by manipulating a lever included in the locking unit. Specifically, if a user pulls the lever, the paper alignment apparatus is locked, and, if the user releases the lever, the paper alignment apparatus is unlocked.

If such a related-art paper alignment apparatus is applied, an additional space should be guaranteed in the paper cassette for moving and manipulating the lever, which is included in the locking unit of the paper alignment apparatus. This is unfavorable for miniaturization of the paper cassette.

SUMMARY OF THE INVENTION

The present inventive concept addresses the above and other drawbacks and disadvantages, and provides a paper cassette which is favorable for miniaturization, and an image forming apparatus having the same.

Additional features and utilities of the present general inventive concept will be set forth in part in the description which follows and, in part, will be obvious from the description, or may be learned by practice of the general inventive concept.

According to exemplary embodiments, there is provided a paper cassette of an image forming apparatus, the paper cassette including: a cassette body containing sheets of paper, and a paper alignment apparatus mounted in the cassette body, wherein the paper alignment apparatus includes: an alignment apparatus body being slidable in a horizontal direction, and a locking unit mounted in the alignment apparatus body and locked into the cassette body in order to block sliding of the alignment apparatus body, wherein the locking unit is locked and unlocked by a downward pressure.

The locking unit may be unlocked if the locked locking unit is downwardly pressed, and may be locked if the unlocked locking unit is downwardly pressed.

The locking unit may include: a button member which is downwardly pressed by a user when locking is achieved and released, and includes a button body and an insertion portion, a guide member which has a cylindrical shape having an inner hollow into which the insertion portion of the button member is inserted, and includes at least one guide recess formed on an inner wall of the hollow, a locking maintaining member which is downwardly pressed by the insertion portion of the button member and includes a least one locking maintaining rib to be inserted into the guide recess of the guide member, a locking member which is downwardly pressed by the locking maintaining member and selectively locked into the cassette body, and an elastic member which elastically supports the locking portion upwardly.

The locking maintaining member may be arranged in the hollow of the guide member when the locking unit is unlocked, and may be released from the hollow of the guide member when the locking unit is locked.

Tooth forms may be formed on a lower end of the guide member and the locking maintaining rib of the locking maintaining member released from the hollow of the guide member may be engaged with the tooth forms.

The button member may be arranged such that at least the button body of the button member is exposed from the alignment apparatus body.

At least one rotation prevention rib may be formed on an outer circumference of the insertion portion of the button member to be inserted into the guide recess of the guide member.

The locking member may include: a contact portion which contacts the locking maintaining member, a locking portion which is locked into the cassette body, and a springing support portion disposed between the contact portion and the locking portion.

The elastic member may be a coil spring that encloses the locking portion.

The alignment apparatus body may include: a vertical portion being disposed opposite to a rear wall of the cassette body in parallel with the rear wall, and a horizontal portion being disposed opposite to a bottom surface of the cassette body in parallel with the bottom surface, and the locking unit may be mounted in the vertical portion.

A plurality of locking recesses may be formed on a bottom surface of the cassette body and the locking portion of the locking member may be locked into a selected locking recess.

According to an aspect of another exemplary embodiment, there is provided an image forming apparatus including the above-described paper cassette.

The locking unit of the paper cassette may include an upper portion which protrudes higher than an upper portion of the vertical portion of the paper alignment apparatus such that the upper portion of the locking unit protrudes to the extent that the upper portion of the locking unit is caught by an upper frame formed on an upper portion of the paper cassette of the image forming apparatus when the paper cassette is closed.

The foregoing and/or other aspects and utilities of the present general inventive concept may also be achieved by providing a method of fixing a paper alignment apparatus of a paper cassette of an image forming apparatus to the paper cassette, the method including sliding the paper alignment apparatus to a desired location; and pressing a button member of a locking unit to insert a locking portion into a locking recess to block sliding movement of the alignment apparatus body and fix the paper alignment apparatus to the paper cassette at the desired location.

The pressing of the button member of the locking unit when in the fixed state releases the paper alignment apparatus from the cassette body and allows sliding movement of the paper alignment apparatus body.

The foregoing and/or other aspects and utilities of the present general inventive concept may also be achieved by providing a paper alignment apparatus for a paper cassette of an image forming apparatus, the paper cassette having a plurality of recesses formed on the bottom surface thereof, the paper alignment apparatus comprising: a horizontal portion; and a vertical portion including a locking unit being mounted therein, the locking unit comprising: a button member; a button body; and a locking portion protruding from a bottom surface of the button body, the locking portion being insertable into any one of the plurality of recesses to lock the locking portion in a selected one of the plurality of recesses to block sliding movement of the paper alignment apparatus.

When the locking portion of the locking unit is in its locked state, that is, when the locking portion is in a selected one of a plurality of recesses, the button member releases the locking portion from the selected recess when downwardly pressed.

The button member may include a locking maintaining member having a plurality of ribs formed on an outer circumference thereof.

The plurality of ribs may be located at equal intervals around the circumference of the locking maintaining member.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
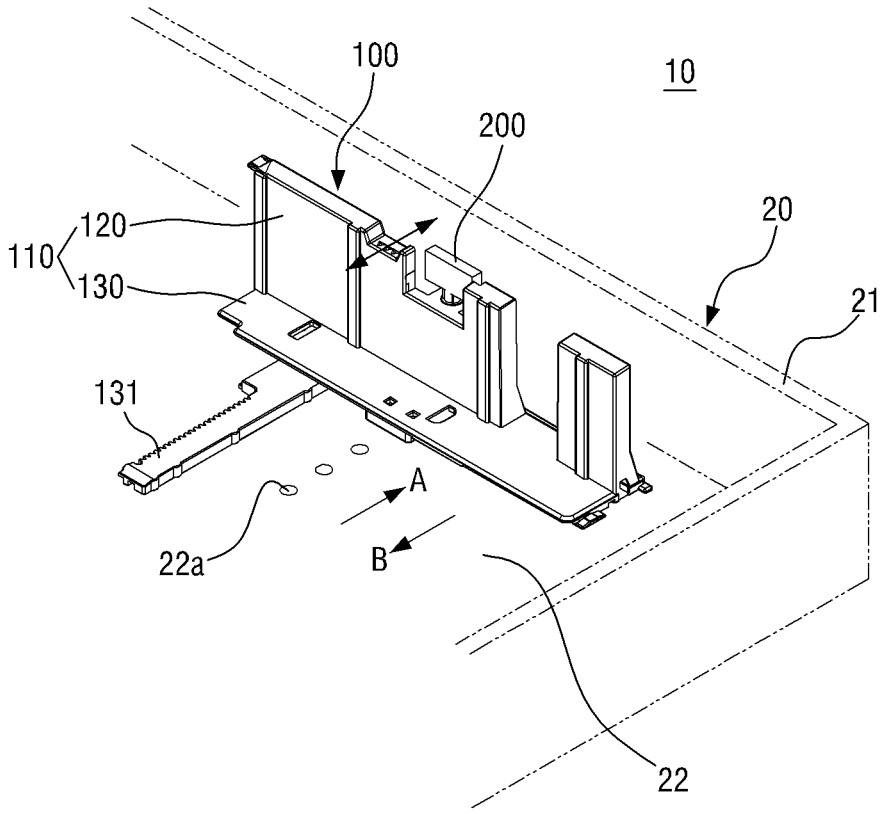
FIG. 1 is a perspective view schematically illustrating a paper cassette according to an exemplary embodiment of the present inventive concept.

Hereinafter, exemplary embodiments will be described in greater detail with reference to the accompanying drawings.

In the following description, same reference numerals are used for the same elements when they are depicted in different drawings. The matters defined in the description, such as detailed construction and elements, are provided to assist in a comprehensive understanding of exemplary embodiments. Thus, it is apparent that exemplary embodiments can be carried out without those specifically defined matters. Also, functions or elements known in the related art are not described in detail since they would obscure the exemplary embodiments with unnecessary detail.

Figure 2:
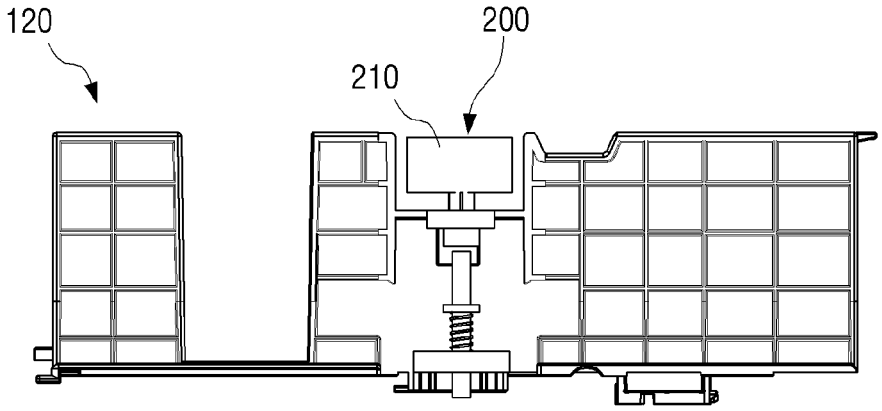
FIG. 2 is a cross sectional view illustrating a paper alignment apparatus included in the paper cassette of FIG. 1.

FIG. 1 is a perspective view schematically illustrating a paper cassette according to an exemplary embodiment, and FIG. 2 is a cross sectional view illustrating a paper alignment apparatus included in the paper cassette of FIG. 1.

A paper cassette 10 includes a cassette body 20 that contains sheets of paper and a paper alignment apparatus 100 that is mounted in the cassette body 20.

The cassette body 20 has a box shape to contain paper and is removably mounted in a body (not shown) of an image forming apparatus.

The paper alignment apparatus 100 is horizontally slidable in the cassette body 20 in a lengthwise direction of the cassette body 20 (that is, an A direction or B direction). A distance between the paper alignment apparatus 100 and a rear wall 21 of the cassette body 20 increases or decreases according to a sliding movement of the paper alignment apparatus 100.

The paper alignment apparatus 100 includes an alignment apparatus body 110 including a vertical portion 120 and a horizontal portion 130, and a locking unit 200 mounted in the vertical portion 120 of the alignment apparatus body 110.

The vertical portion 120 of the alignment apparatus body 110 is arranged in parallel with the rear wall 21 of the cassette body 20, and serves to align sheets of paper contained in the paper cassette 10 in contact with inner corners of the sheets of paper. The horizontal portion 130 of the alignment apparatus body 110 is arranged in parallel with a bottom surface of the cassette body 20, and moves in a lengthwise direction (A direction or B direction) of the cassette body 20 so that the vertical portion 120 approaches the sheets of paper or retreats from them. A rack gear 131 is mounted in the horizontal portion 130 of the alignment apparatus body 110.

The locking unit 200 is mounted in the vertical portion 120 of the alignment apparatus body 110 in order to block the sliding movement of the alignment apparatus body 110. More specifically, the locking unit 200 is disposed at a center of the vertical potion 120 of the alignment apparatus body 110 and most of the locking unit 200 is hidden in the vertical portion 120 except for a part thereof (exactly, a button member, which will be described later), as shown in FIG. 2.

Hereinafter, the locking unit 200 will be described in detail with reference to FIGS. 3 to 9.

Figure 3:
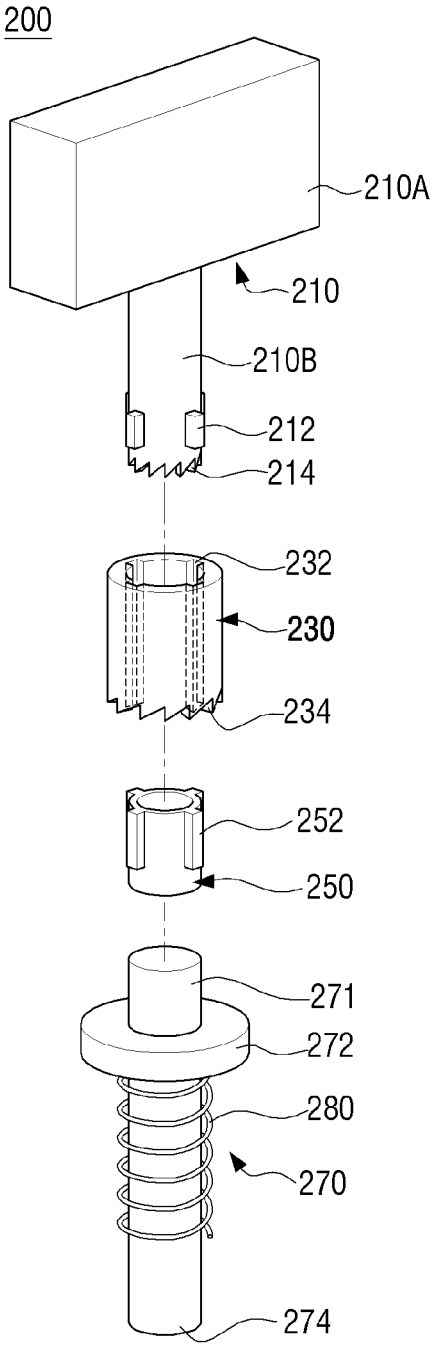
FIG. 3 is an exploded perspective view illustrating a locking unit of the paper alignment apparatus included in the paper cassette of FIG. 1.

FIG. 3 is an exploded perspective view illustrating the locking unit of the paper alignment apparatus included in the paper cassette of FIG. 1.

Referring to FIG. 3, the locking unit 200 includes a button member 210 that is downwardly pressed by the user, a guide member 230 that guides a vertical movement of the button member 210, a locking maintaining member 250 that has one side brought into contact with the button member 210 and is vertically movable, and a locking member 270 that is locked into a selected locking recess 22*a* among plural locking recesses 22*a* of the cassette body 20.

The button member 210 includes a button body 210A, and an insertion portion 210B that protrudes from a bottom surface of the button body 210A.

The button body 210A is a portion that is pressed by the user when the locking unit 200 is locked or unlocked, and is exposed to the outside of the alignment apparatus body 110 as shown in FIG. 2. The button body 210A has a substantially rectangular shape. However, any other alternative shape may be applied.

The insertion portion 210B of the button member 210 has a substantially tubular shape that has an inner hollow. A plurality of rotation prevention ribs 212 are formed on an outer circumference of the button member 210 to prevent the insertion portion 210B from being rotated about a central axis thereof when the button member 210 vertically moves.

In the present exemplary embodiment, four rotation prevention ribs 212 are provided. However, a different number of rotation prevention ribs (for example, one, three, five, or six rotation prevention ribs) may be provided as long as the intended purposes of the inventive concept are provided, as described herein. The rotation prevention ribs 212 have a rib shape and are inserted into guide recesses 232 of the guide member 230, which will be described.

A sawtoothed button member tooth form 214 maybe formed on a lower end of the insertion portion 210B of the button member 210 and is provided to be contactable with an upper end of the locking maintaining member 250. Alternatively, the button member tooth form 214 may not be provided, and the lower end of the insertion portion 210B of the button member 210 may be contactable with the upper end of the locking maintaining member 250 and can vertically move the locking maintaining member 250 when the button member 210 is downwardly pressed.

The guide member 230 has a substantially cylindrical shape that has an inner hollow, and is fixedly mounted in a guide member seating portion 121 included in the vertical portion 120 (see FIG. 1) of the alignment apparatus body 110.

A plurality of guide recesses 232 are formed on an inner wall of the guide member 230. In the present exemplary embodiment, four guide recesses 232 are provided in accordance with the number of rotation prevention ribs 212 described above. The guide recesses 232 are formed on the inner wall of the guide member 230 in a lengthwise direction of the guide member 230. The rotation prevention ribs 212 of the button member 210 and locking maintaining ribs 252 of the locking maintaining member 250, which will be described later, are inserted into the guide recesses 232.

A sawtoothed guide member tooth form 234 can be formed on a lower end of the guide member 230 in a circumferential direction.

The locking maintaining member 250 is a member to maintain a locking state of the locking member 270, and has a substantially cylindrical shape that has an inner hollow. A plurality of locking maintaining ribs 252 may be formed on an outer circumference of the locking maintaining member 250. In the present exemplary embodiment, four locking maintaining ribs 252 are provided in accordance with the number of rotation prevention ribs 212 described above. However, a different number of locking maintaining ribs 252 may be provided which perform the intended purposes of the inventive concept as described herein.

The locking maintaining ribs 252 may be located at equal intervals.

The locking member 270 includes a contact portion 271 that is downwardly pressed by the locking maintaining member 250 in contact with the locking maintaining member 250, a springing support portion 272 that prevents an elastic member 280 from being released, and a locking portion 274 that penetrates through a penetrating hole 114 formed on the horizontal portion 130 of the alignment apparatus body 110 and is locked into a selected locking recess 22*a* formed on a bottom 22 of the cassette body 20.

The elastic member 280 provides an upward elastic force to the locking member 270 and may be a coil spring as in the present exemplary embodiment.

Hereinafter, a locking operation and an unlocking operation of the locking unit 200 will be described with reference to FIGS. 4 to 9.

Figure 4:
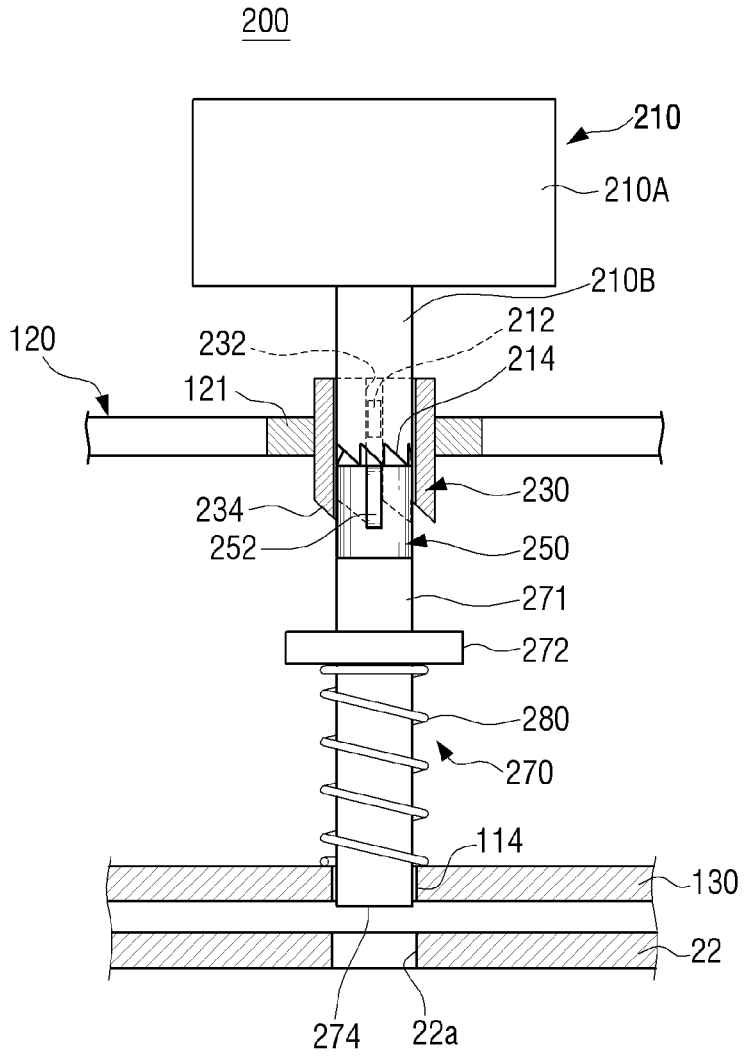
FIG. 4 is a cross sectional view illustrating the locking unit of FIG. 3 that is unlocked.
Figure 5:
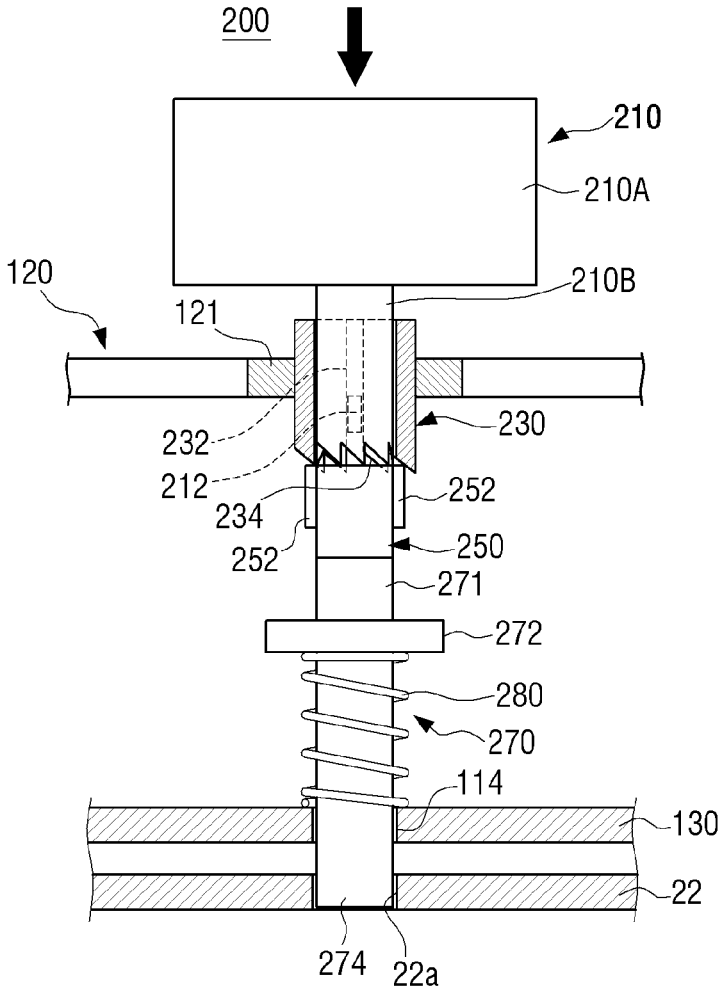
FIG. 5 is a cross sectional view illustrating the locking unit of FIG. 3 that is locked.
Figure 6:
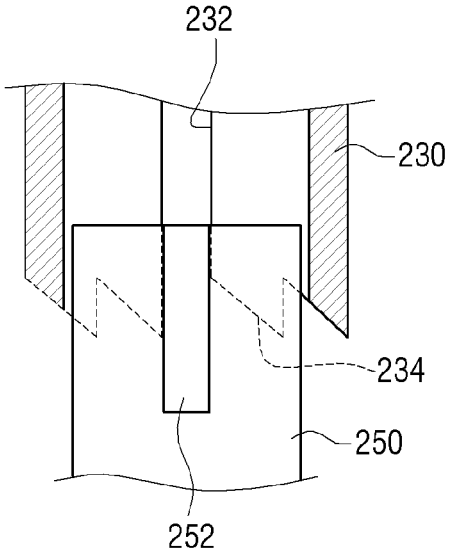
FIGS. 6 to 8 are cross sectional views illustrating movements of a locking maintaining member included in the locking unit of FIG. 3 in sequence when the locking unit is locked.
Figure 7:
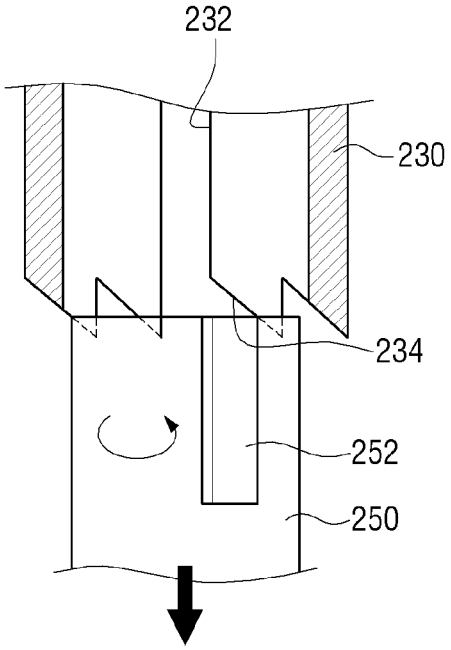
Figure 8:
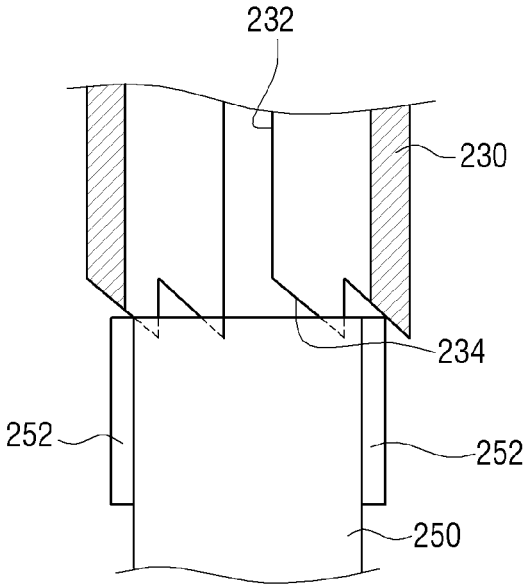
Figure 9:
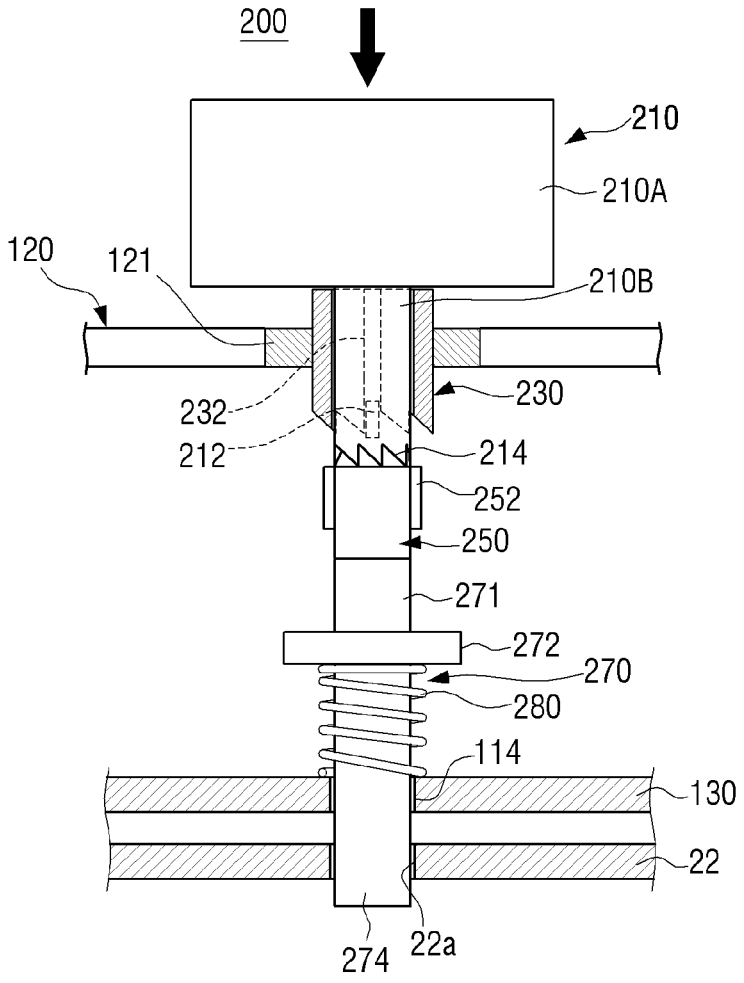
FIG. 9 is a cross sectional view illustrating an unlocking operation of the locking unit of FIG. 3.

FIG. 4 is a cross sectional view illustrating the locking unit of FIG. 3 that is unlocked, FIG. 5 is a cross sectional view illustrating the locking unit of FIG. 3 that is locked, FIGS. 6 to 8 are cross sectional views illustrating movements of the locking maintaining member of the locking unit of FIG. 3 in sequence when the locking unit is locked, and FIG. 9 is a cross sectional view illustrating the locking unit of FIG. 3 when the locking unit is unlocked.

A locking operation of the locking unit 200 will be explained first.

In the state in which the locking unit 200 is unlocked as shown in FIG. 4, the locking portion 274 of the locking member 270 is not inserted into any of the locking recesses 22*a* formed on the bottom 22 of the cassette body 20, and accordingly, the paper alignment apparatus 100 is not restrained by the cassette body 20 and is free to slide.

In order to fix the paper alignment apparatus 100 to the cassette body 20, the user downwardly presses the button body 210A of the button member 210 in an arrow direction as shown in FIG. 5. Then, the button member 210 downwardly moves and downwardly pushes the locking maintaining member 250, and simultaneously, the locking maintaining member 250 downwardly pushes the locking member 270. At this time, the locking portion 274 of the locking member 270 is locked into any of the locking recesses 22*a* formed on the bottom 22 of the cassette body 20 so that the paper alignment apparatus 100 can be fixed to the cassette body 20.

More specifically, if the user downwardly presses the button member 210, the button member 210 downwardly moves and simultaneously the rotation prevention ribs 212 of the button member 210 move along the guide recesses 232 of the guide member 230. Therefore, the button member 210 is prevented from being rotated. Also, as the button member 210 downwardly moves, the locking maintaining member 250 downwardly moves. At this time, the locking maintaining ribs 252 of the locking maintaining member 250 are released from the guide recesses 232 of the guide member 230 and are rotated by a predetermined angle due to the action of a downward force exerted by the button member 210 and an upward force exerted by the elastic member 280, so that the locking maintaining ribs 252 can be engaged with the guide member tooth form 234 of the guide member 230.

A process in which the locking maintaining ribs 252 are released from the guide recesses 232 of the guide member 230 and are engaged with the guide member tooth form 234 will be understood with reference to FIGS. 6 to 8. If the user presses the button member 210, the locking maintaining ribs 252 of the locking maintaining member 250 are released from the guide member 230 and simultaneously the locking maintaining member 250 is rotated by a predetermined angle (for example, 90°) as shown in FIG. 7. Then, as shown in FIG. 8, the locking maintaining ribs 252 of the locking maintaining member 250 are engaged with the guide member tooth form 234 and accordingly the locking state of the locking member 270 is maintained.

Next, an unlocking operation of the locking unit 200 will be explained.

In the state in which the locking unit 200 is locked as shown in FIG. 9, if the user downwardly presses the button member 210 again, the whole locking unit 200 which is locked further moves downwardly. Then, the locking maintaining ribs 252 are disengaged from the guide member tooth form 234 and simultaneously the locking maintaining member 250 is rotated again by a predetermined angle (for example, 90°) so that the locking maintaining ribs 252 are aligned with the guide recesses 232 of the guide member 230.

In this state, if the user releases the button member 210, the locking member 270 is upwardly moved by the upward elastic force of the elastic member 280 so that the locking portion 274 is released from the selected locking recess 22*a* formed on the bottom 22 of the cassette body 20 and thus the locking unit 200 is unlocked, as shown in FIG. 4. At this time, the locking maintaining member 250 contacting the upper portion of the locking member 270 is upwardly moved with the locking maintaining ribs 252 being inserted into the guide recesses 232 of the guide member 230, and the button member 210 contacting the upper portion of the locking maintaining member 250 is also upwardly moved.

Hereinafter, a sliding operation of the paper alignment apparatus 100 will be described. The paper alignment apparatus 100 is slidable when the locking unit 200 is unlocked. That is, if the user wishes to align sheets of paper by the sliding movement of the paper alignment apparatus 100, the user unlocks the locking unit 200 first and then places the paper alignment apparatus 100 at a desirable location by slidably moving the paper alignment apparatus horizontally in the arrow direction shown in FIG. 1. Accordingly, if a desirable location of the paper alignment apparatus 100 is determined, the user presses the button member 210 of the locking unit 200 and fixes the paper alignment apparatus 100 to the cassette body 20.

In the present exemplary embodiment, the sliding movement of the alignment apparatus body 110 in the paper cassette 10 may be blocked or allowed by downwardly pressing the locking unit 200. Accordingly, since a space of the cassette body 20 for the locking operation of the user can be minimized, the paper cassette 10 can be miniaturized.

Figure 10:
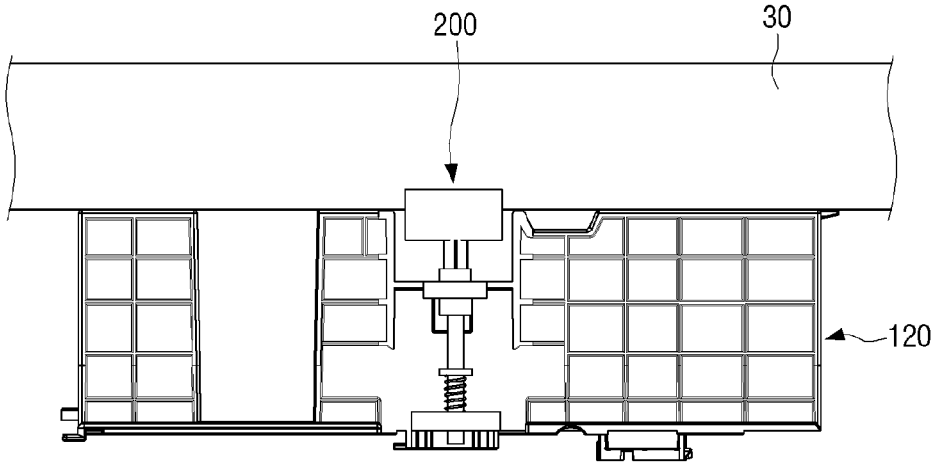
FIG. 10 is a cross sectional view to explain an arrangement relationship between the paper alignment apparatus and an upper frame when the locking unit of FIG. 3 is unlocked.

FIG. 10 is a cross sectional view to explain an arrangement relationship between the paper alignment apparatus and an upper frame when the locking unit of FIG. 3 is unlocked.

As shown in FIG. 10, when the locking unit 200 is unlocked, an upper portion of the locking unit 200 protrudes higher than an upper portion of the vertical portion 120 of the paper alignment apparatus 100. The upper portion of the locking unit 200 protrudes to the extent that the upper portion is caught by an upper frame 30 formed on an upper portion of the paper cassette 10 of the image forming apparatus when the paper cassette 10 is closed. Accordingly, if the paper cassette 10 is closed when the locking unit 200 is not locked, the upper portion of the locking unit 200 is caught by the upper frame 30 so that the user can easily identify whether the locking is achieved or not. Of course, the user can easily identify whether the locking is achieved or not with user's naked eyes.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A paper cassette of an image forming apparatus, the paper cassette comprising:

a cassette body containing sheets of paper; and a paper alignment apparatus mounted in the cassette body, the paper alignment apparatus comprising:

an alignment apparatus body slidable in a horizontal direction; and a locking unit mounted in the alignment apparatus body and locked into the cassette body to block sliding of the alignment apparatus body, the locking unit being locked and unlocked by a downward pressure applied at a same location of the locking unit.

2. The paper cassette according to claim 1, wherein the locking unit is unlocked if the locked locking unit is downwardly pressed, and is locked if the unlocked locking unit is downwardly pressed.

3. The paper cassette according to claim 1, wherein the locking unit comprises:

a button member which is downwardly pressed by a user when locking is achieved and released, and comprises a button body and an insertion portion;

a guide member which has a cylindrical shape having an inner hollow into which the insertion portion of the button member is inserted, and comprises at least one guide recess formed on an inner wall of the hollow;

a locking maintaining member which is downwardly pressed by the insertion portion of the button member and comprises a least one locking maintaining rib to be inserted into the guide recess of the guide member;

a locking member which is downwardly pressed by the locking maintaining member and is selectively locked into the cassette body; and an elastic member which elastically supports the locking portion upwardly.

4. The paper cassette according to claim 3, wherein the locking maintaining member is arranged in the hollow of the guide member when the locking unit is unlocked, and is released from the hollow of the guide member when the locking unit is locked.

5. The paper cassette according to claim 4, wherein tooth forms are formed on a lower end of the guide member and the locking maintaining rib of the locking maintaining member released from the hollow of the guide member is engaged with the tooth forms.

6. The paper cassette according to claim 3, wherein the button member is arranged such that at least the button body of the button member is exposed from the alignment apparatus body.

7. The paper cassette according to claim 3, wherein at least one rotation prevention rib is formed on an outer circumference of the insertion portion of the button member to be inserted into the guide recess of the guide member.

8. The paper cassette according to claim 3, wherein the locking member comprises:

a contact portion which contacts the locking maintaining member;

a locking portion which is locked into the cassette body; and a springing support portion which is disposed between the contact portion and the locking portion.

9. The paper cassette according to claim 8, wherein the elastic member is a coil spring that encloses the locking portion.

10. The paper cassette according to claim 3, wherein the alignment apparatus body comprises:

a vertical portion which is disposed opposite to a rear wall of the cassette body in parallel with the rear wall; and a horizontal portion which is disposed opposite to a bottom surface of the cassette body in parallel with the bottom surface, wherein the locking unit is mounted in the vertical portion.

11. The paper cassette according to claim 3, wherein a plurality of locking recesses are formed on a bottom surface of the cassette body and the locking portion of the locking member is locked into a selected locking recess.

12. The paper cassette according to claim 1, wherein an upper portion of the locking unit protrudes higher than an upper portion of a vertical portion of the paper alignment apparatus such that the upper portion of the locking unit protrudes to the extent that the upper portion of the locking unit is caught by an upper frame formed on an upper portion of the paper cassette of the image forming apparatus when the paper cassette is closed.

13. An image forming apparatus comprising a paper cassette, the paper cassette comprising:

a cassette body which contains sheets of paper; and a paper alignment apparatus mounted in the cassette body, the paper alignment apparatus comprising:

an alignment apparatus body being slidable in a horizontal direction; and a locking unit mounted in the alignment apparatus body and locked into the cassette body to block sliding of the alignment apparatus body, the locking unit being locked and unlocked by a downward pressure on a same location of the locking unit.

14. A paper alignment apparatus for a paper cassette of an image forming apparatus, the paper cassette having a plurality of recesses formed on the bottom surface thereof, the paper alignment apparatus comprising:

a horizontal portion; and a vertical portion including a locking unit being mounted therein, the locking unit comprising:

a button body; and a locking portion protruding from a bottom surface of the button body, the locking portion being insertable into any one of the plurality of recesses to lock the locking portion in a selected one of the plurality of recesses to block sliding movement of the paper alignment apparatus upon a downward pressure on a location of the button body, the locking portion being released from its locked position upon a downward pressure on the same location of the button body.

15. The paper alignment apparatus according to claim 14, wherein the button member further comprises:

a locking maintaining member having a plurality of ribs formed on an outer circumference thereof.

16. The paper alignment apparatus according to claim 15, wherein the ribs are located at equal intervals around the circumference of the locking maintaining member.

17. A method of fixing a paper alignment apparatus of a paper cassette of an image forming apparatus to the paper cassette, the method comprising:

sliding the paper alignment apparatus to a desired location; and pressing a location of a button member of a locking unit to insert a locking portion into a locking recess to block sliding movement of the paper alignment apparatus and fix the paper alignment apparatus to the paper cassette at the desired location; and pressing the same location of the button member to release the locking portion from the locking recess to allow sliding movement of the paper alignment apparatus.

18. A paper alignment apparatus of a paper cassette comprising:

a vertical portion to align sheets of paper contained in the paper cassette; and a locking unit disposed within the vertical portion and arranged to lock the alignment apparatus at a desired position upon a downward pressure on a location of the locking unit, and to unlock the alignment apparatus upon a downward pressure on the same location of the button member to allow a sliding movement of the paper alignment apparatus.

* * * * *